United States Patent [19]

Mack

[11] Patent Number: 4,899,531

[45] Date of Patent: Feb. 13, 1990

[54] METHOD AND APPARATUS FOR AUTOMATIC EXCHANGE OF ROVING BOBBINS OF A RING SPINNING MACHINE

[75] Inventor: Karl-Heinz Mack, Weilheim, Fed. Rep. of Germany

[73] Assignee: Zinser Textilmaschinen GmbH, Fed. Rep. of Germany

[21] Appl. No.: 254,874

[22] Filed: Oct. 7, 1988

[30] Foreign Application Priority Data

Oct. 9, 1987 [DE] Fed. Rep. of Germany ..... 3734264

[51] Int. Cl.[4] ..... D01H 13/00; D01H 15/00

[52] U.S. Cl. ..... 57/281; 57/261; 57/270

[58] Field of Search ..... 57/261, 266, 267, 268, 57/271, 273, 281, 270

[56] References Cited

U.S. PATENT DOCUMENTS

| | | | |
|---|---|---|---|
| 4,438,622 | 3/1984 | Pons | 57/261 |
| 4,473,997 | 10/1984 | Kawasaki et al. | 57/281 X |
| 4,583,358 | 4/1986 | Krieger et al. | 57/270 X |
| 4,586,326 | 5/1986 | Igel | 57/270 X |
| 4,630,435 | 12/1986 | Igel | 57/270 X |
| 4,739,611 | 4/1988 | Rohner | 57/281 X |
| 4,771,597 | 9/1988 | Igel et al. | 57/268 X |
| 4,799,353 | 1/1989 | Kawasaki et al. | 57/281 |

FOREIGN PATENT DOCUMENTS

| | | | |
|---|---|---|---|
| 213962 | 3/1987 | European Pat. Off. | 57/281 |
| 2158657 | 3/1976 | Fed. Rep. of Germany | 57/281 |

*Primary Examiner*—Joseph J. Hail, III

*Attorney, Agent, or Firm*—Shefte, Pinckney & Sawyer

[57] ABSTRACT

A method and apparatus for exchanging roving bobbins on a ring spinning machine or the like. A temporary storage spindle is provided in a service unit which services the ring spinning machine and a roving cutting and piecing apparatus and a spindle are movable between the temporary storage spindle, the bobbin holder of the spinning machine and a spare bobbin frame of the spinning machine to receive and transfer bobbins thereat to the temporary storage spindle, the bobbin holder or the spare bobbin frame. In one exchange process, the bobbin on the bobbin holder is transferred directly to the spare bobbin frame after the bobbin on the spare bobbin frame has been transferred to the temporary storage spindle. Thereafter, the bobbin on the temporary storage spindle is transferred to the bobbin holder. According to another exchange process, the bobbin on the spare bobbin frame is transferred directly to the bobbin holder after the bobbin on the bobbin holder has been transferred to the temporary storage spindle. Thereafter, the bobbin on the temporary storage spindle is transferred to the spare bobbin frame.

26 Claims, 17 Drawing Sheets

METHOD AND APPARATUS FOR AUTOMATIC EXCHANGE OF ROVING BOBBINS OF A RING SPINNING MACHINE

BACKGROUND OF THE INVENTION

The present invention relates to a method and apparatus for automatically exchanging the roving bobbin of a ring spinning machine. More specifically, the present invention relates to a method and apparatus for exchanging roving bobbins by means of a movable service unit which can be moved to the spinning stations of a ring spinning machine.

During a yarn spinning process, a ring spinning machine draws roving from a supply bobbin suspended above a spinning bobbin onto which spun yarn is wound. Oftentimes, the roving is simultaneously fed from a second bobbin suspended adjacent the first bobbin. The roving on each bobbin eventually is completely drawn from its supply bobbin and, ideally, a new, full roving bobbin is in position to be quickly substituted for the empty bobbin so that little or no disruption in the spinning process occurs. To this end, spare roving bobbins are typically suspended above and adjacent to the roving bobbins from which yarn is already being drawn. To exchange a full roving bobbin for an empty bobbin, a service unit is movable to a station at which the empty roving bobbin is suspended for operation in conjunction with apparatus coupled to the ring spinning machine to effect an exchange of the bobbins.

In European patent publication A 0 213 962, a service unit for exchanging bobbins on a ring spinning machine is disclosed. The service unit includes two gripping elements which can be moved to support and transfer a full bobbin suspended on a spare bobbin frame or an empty bobbin suspended on the ring spinning machine and whose movement must be coordinated. However, the extent of the equipment necessary to operate two gripping elements and to coordinate their movements adds considerable complexity to this type of roving bobbin exchange apparatus. Furthermore, additional equipment is required to move the innermost row of roving bobbins to a position in which the apparatus can access the bobbins.

In German Pat. No. 32 46 463 A1, a movable service unit is disclosed for delivering full roving bobbins to the spare bobbin frame of a ring spinning machine. In German Pat. No. 28 11 128 C2, a movable service unit is disclosed for removing a package wound on the spindle bank of a ring spinning machine and for inserting a new core on the spindle of the spindle bank to continue the spinning process. However, the need exists for a method and apparatus for exchanging empty or nearly empty bobbins on a ring spinning machine for full roving bobbins with minimum interruption to the spinning process.

SUMMARY OF THE INVENTION

The present invention provides a method and apparatus for exchanging bobbins on a bobbin holder of a spinning machine for full bobbins on a spare bobbin frame of the spinning machine.

Briefly described, one method according to the present invention for exchanging a full roving bobbin stored on a spare bobbin frame for another roving bobbin on a bobbin holder of a ring spinning machine or the like in which roving or the like is fed from the bobbin for processing in the ring spinning machine includes the steps of transferring the full roving bobbin from the spare bobbin frame to a service unit adjacent the ring spinning machine, transferring the other roving bobbin from the bobbin holder to the spare bobbin frame while substantially continuously rotating the bobbin to maintain the feed of roving yarn therefrom, transferring the full roving bobbin from the service unit to the bobbin holder, piecing the roving from the full bobbin with the roving from the other bobbin and severing the roving from the other bobbin from the roving from the full bobbin after piecing the roving from the full bobbin therewith. Preferably, the method also includes readying the roving from the full roving bobbin for subsequent piecing of the end with the roving from the other roving bobbin before moving the full roving bobbin from the service unit to the bobbin holder.

In one preferred embodiment of an apparatus according to the present invention, an apparatus in a service unit for a spinning machine is provided for exchanging roving bobbins on a bobbin holder of the spinning machine in which roving or the like is fed from the bobbins for processing in the spinning machine for full roving bobbins on a spare bobbin frame of the spinning machine and includes means for temporarily supporting a bobbin, means, movable between the bobbin holder, the spare bobbin frame and the supporting means, for sequentially transferring a full bobbin from the spare bobbin frame to the supporting means, transferring a bobbin directly from the bobbin holder to the spare bobbin frame, and transferring the full bobbin from the supporting means to the bobbin holder, means for piecing the roving from the full bobbin with the roving from the other bobbin and means for severing the roving from the other bobbin from the roving from the full bobbin after piecing the roving from the full bobbin therewith.

In another embodiment of the apparatus according to the present invention, an apparatus in a service unit for a spinning machine or the like is provided for exchanging roving bobbins on a bobbin holder of the spinning machine in which roving or the like is fed from the bobbins for processing in the spinning machine for full roving bobbins on a spare bobbin frame of the spinning machine and includes means for temporarily supporting a bobbin, means, movable between the bobbin holder, the spare bobbin frame and the supporting means, for sequentially transferring a bobbin from the bobbin holder to the supporting means, transferring a full bobbin directly from the spare bobbin frame to the bobbin holder and transferring the bobbin from the supporting means to the spare bobbin holder, means for piecing the roving from the full bobbin with the roving from the other bobbin and means for severing the roving from the other bobbin from the roving from the full bobbin after piecing the roving from the full bobbin therewith.

Preferably, the means for transferring is movable to additional roving bobbins in lateral disposition to the bobbin on the bobbin holder for transferring the additional bobbins. Also, the apparatus preferably also includes a movable vacuum device for pre-positioning the end of the roving from the full bobbin. Additionally, the apparatus preferably includes a gripper for gripping the end of roving of the full roving bobbin.

In one modification of the gripper of the apparatus of the present invention, the gripper includes an outwardly projecting, clamping member for gripping the yarn which is positionable in an open, roving receiving position, a closed, roving gripping position and a partially open, roving guiding position. According to a further modification, the gripper includes means for rotating about an axis generally transverse to the direction of roving feed and means for rotating about an axis generally parallel to roving feed.

In another aspect of the preferred embodiment of the present invention, the apparatus includes means for rotating a bobbin suspended from the temporary support means.

Further features and advantages of the present invention will be apparent from the accompanying drawings and the following detailed description of the preferred embodiment.

BRIEF DESCRIPTION OF THE DRAWINGS

FIG. 17 is a view similar to a portion of FIG. 16, showing the gripping jaws in closed position;

FIG. 18 is a view similar to FIG. 17, showing the gripping jaws in a partially open position in which the jaws define a guide for receiving the free end of the roving from the full bobbin therein;

DETAILED DESCRIPTION OF PREFERRED EMBODIMENTS

Figure 1:
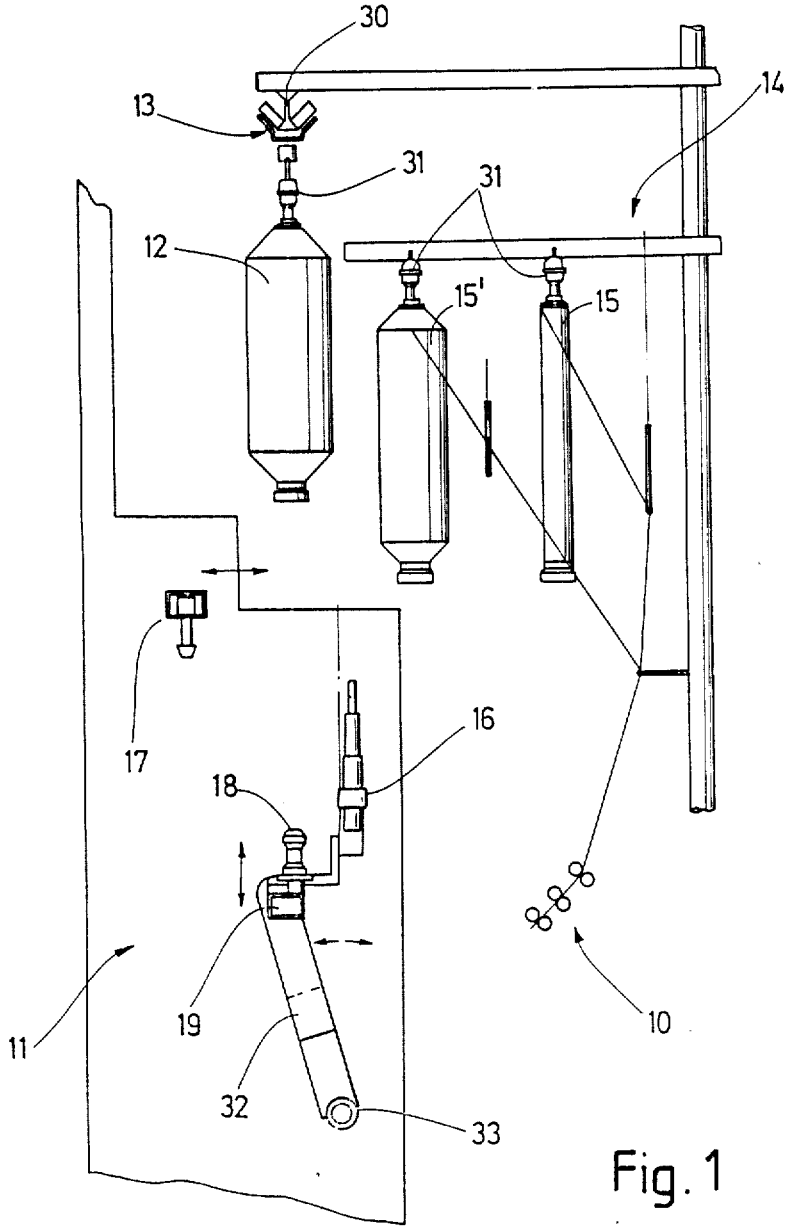
FIG. 1 is a side elevational view of a portion of a service unit incorporating one preferred embodiment of the automatic roving bobbin exchange apparatus of the present invention, showing the roving bobbin holder on which the roving bobbins are suspended during withdrawal of roving therefrom and showing the position of the components of the apparatus at the beginning of an exchange sequence.

As shown in FIG. 1, a ring spinning machine having a drafting apparatus 10 and a roving bobbin holder 14 is serviced by a service unit 11 movable along the length of the ring spinning machine. A spare bobbin frame 30 projecting over the path of the service unit 11 has a rail 13 extending longitudinally along the ring spinning machine. The rail 13 has a plurality of creels 31 from which a plurality of full roving bobbins 12 are suspended. Only the frontmost roving bobbin holder 14, spare bobbin holder 30, creel 31 and full roving bobbin 12 thereon are shown in FIG. 1, the other roving bobbin holders, spare bobbin holders, creels and full roving bobbins therebehind being identical to the one illustrated.

The roving bobbin holder 14 includes two creels 31 each for supporting a roving bobbin 15 and 15', respectively, which feed roving to the drafting apparatus 10. The creels 31 have conventional grippers for gripping the full roving bobbins 12 and the roving bobbins 15 and 15'.

The service unit 11 transports the automatic roving bobbin exchange apparatus of the present invention to each roving bobbin station of the ring spinning machine to accomplish the automatic roving bobbin exchange process. The preferred embodiment of the automatic roving bobbin exchange apparatus of the present invention includes a roving cutting and piecing apparatus 16 and a spindle 18 mounted on a support bracket 19 which is movably coupled to the free end of a transfer arm 32 pivotally coupled at a pivot 33 to the service unit 11. The preferred embodiment also includes a temporary storage spindle 17 movably mounted to the service unit 11. Preferably, the service unit 11 is provided with a number of automatic roving bobbin exchange apparatus identical to the preferred embodiment so that the service unit can service a number of roving bobbin stations simultaneously.

A drive mechanism (not shown) mounted in the support bracket 19 rotates the spindle 18 about its axis. The pivot 33 is movable relative to the service unit 11 in the vertical direction so that the transfer arm 32 can be simultaneously pivoted about the pivot 33 and moved vertically up and down through movement of the pivot 33. Since the support bracket 19 is pivotally coupled to the free end of the transfer arm 32, the spindle 18 and the cutting and piecing apparatus 16 can be manipulated to access the roving bobbins by the coordinated movement of the pivot 33, the transfer arm 32 and the support bracket 19 relative to one another and to the service unit 11. Additionally, the range of movement of the spindle 18 allows the spindle to deliver and retrieve a bobbin from the temporary storage spindle 17. However, in the automatic roving bobbin exchange apparatus of the present invention of the preferred embodiment, the temporary storage spindle 17 can be moved with respect to the service unit 11 to align a bobbin suspended therefrom with the spindle 18.

With reference now to FIGS. 1-15, the operation of the automatic roving bobbin exchange apparatus of the present invention to exchange a nearly empty bobbin (hereinafter "empty bobbin") 15 for a full bobbin 12 will now be described. As shown in FIG. 1, the pivot 33 is in its lowermost vertical position and the spindle 18 is vertically aligned with the axis of the full roving bobbin 12. Also, the temporary storage spindle 17 is in its initial retracted position adjacent the side of the service unit 11 facing away from the ring spinning machine. The roving from the bobbin 15' and the empty bobbin 15 is fed through respective guides and then through a common guide to the drafting apparatus 10.

Figure 2:
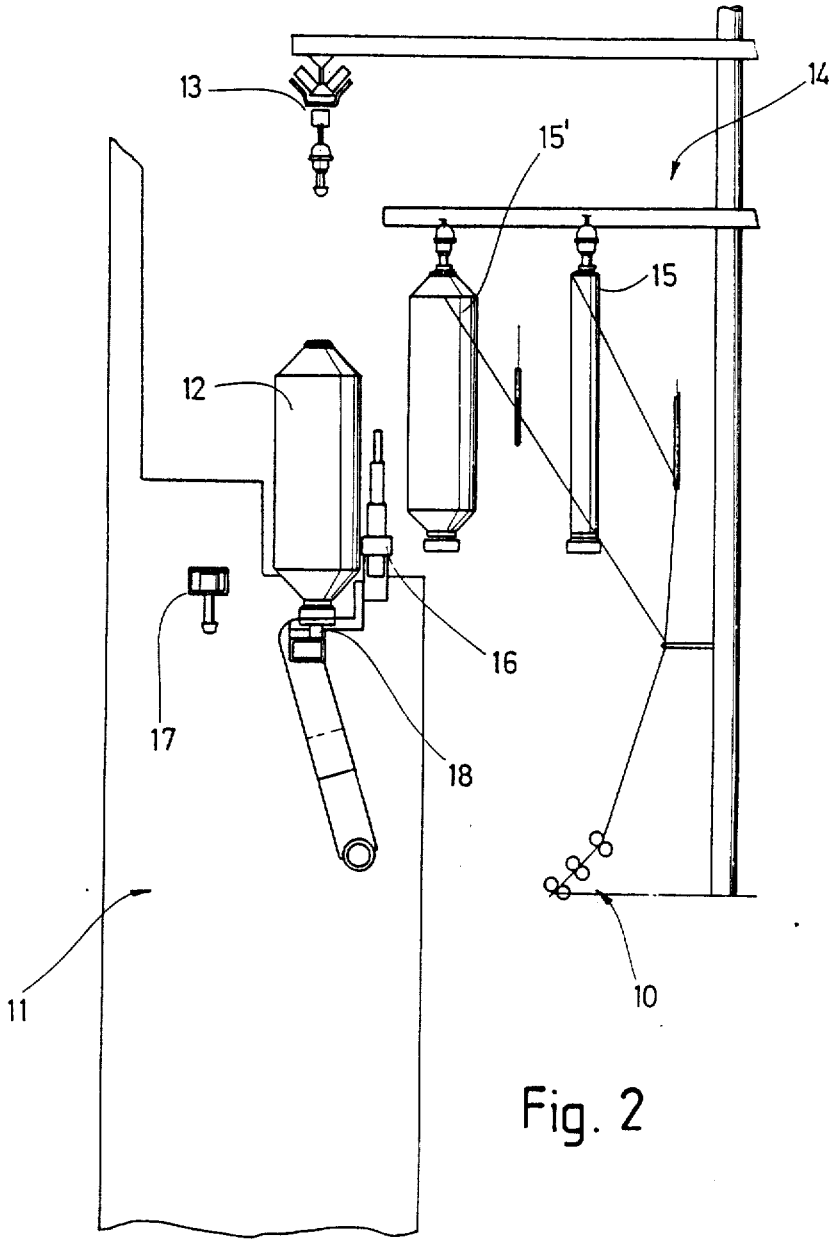
FIG. 2 is a view similar to FIG. 1, showing the position of the components immediately after the automatic roving bobbin exchange apparatus has removed a full roving bobbin from the spare bobbin frame.
Figure 3:
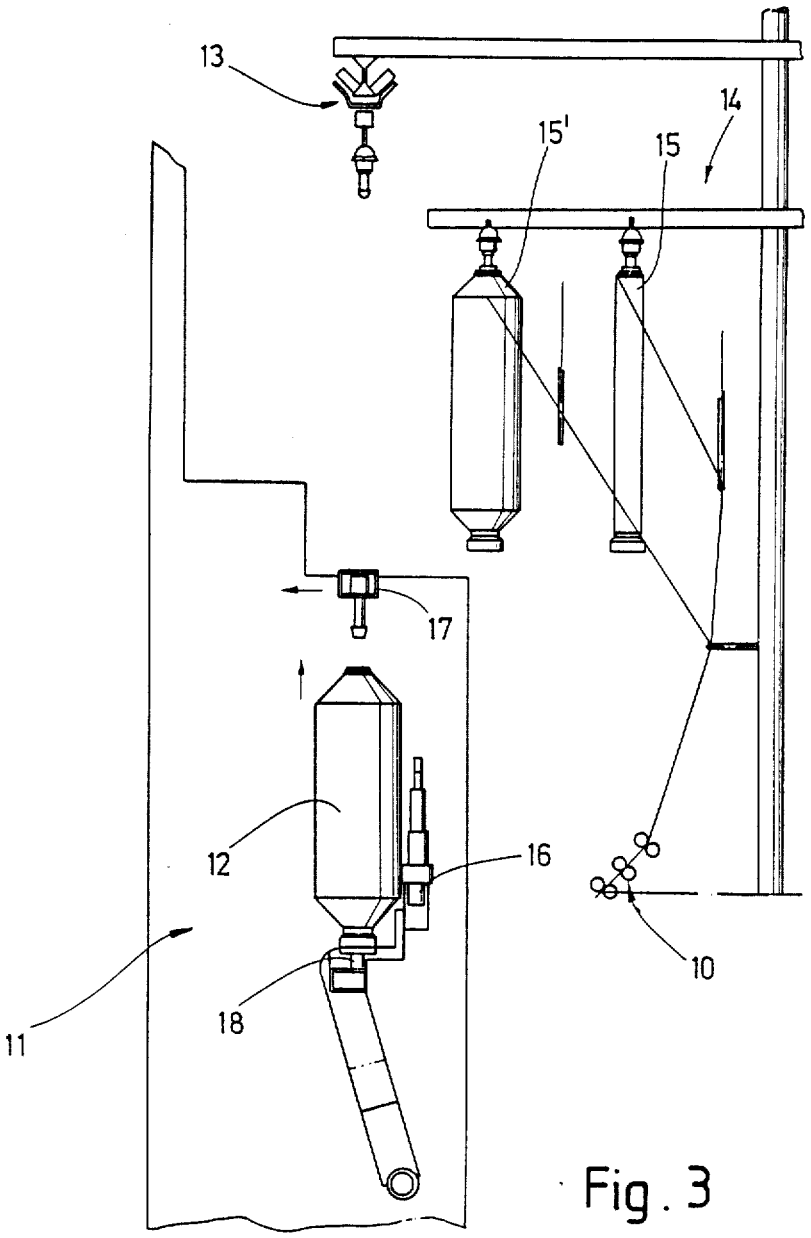
FIG. 3 is a view similar to FIG. 1, showing the temporary storage spindle of the apparatus positioned in axial alignment with the full roving bobbin immediately before the bobbin is raised onto the temporary storage spindle.

As shown in FIG. 2, the full roving bobbin 12 is transferred to the spindle 18 by moving the pivot 33 upward to insert the spindle into the lower end of the bobbin. Once the bobbin is inserted on the spindle 18, the pivot 33 is moved downward to its initial lowermost position, as shown in FIG. 3. Then, the temporary storage spindle 17 is moved from its initial retracted position to a position in which it is vertically aligned with the full roving bobbin support means such as a 12 supported therebelow. Subsequently, the pivot 33 is moved upward to effect placement of the bobbin 12 onto the temporary storage spindle 17 and the pivot is then moved downward to withdraw the spindle 18 from the bottom of the bobbin, thereby leaving the bobbin suspended on the temporary storage spindle 17.

Figure 4:
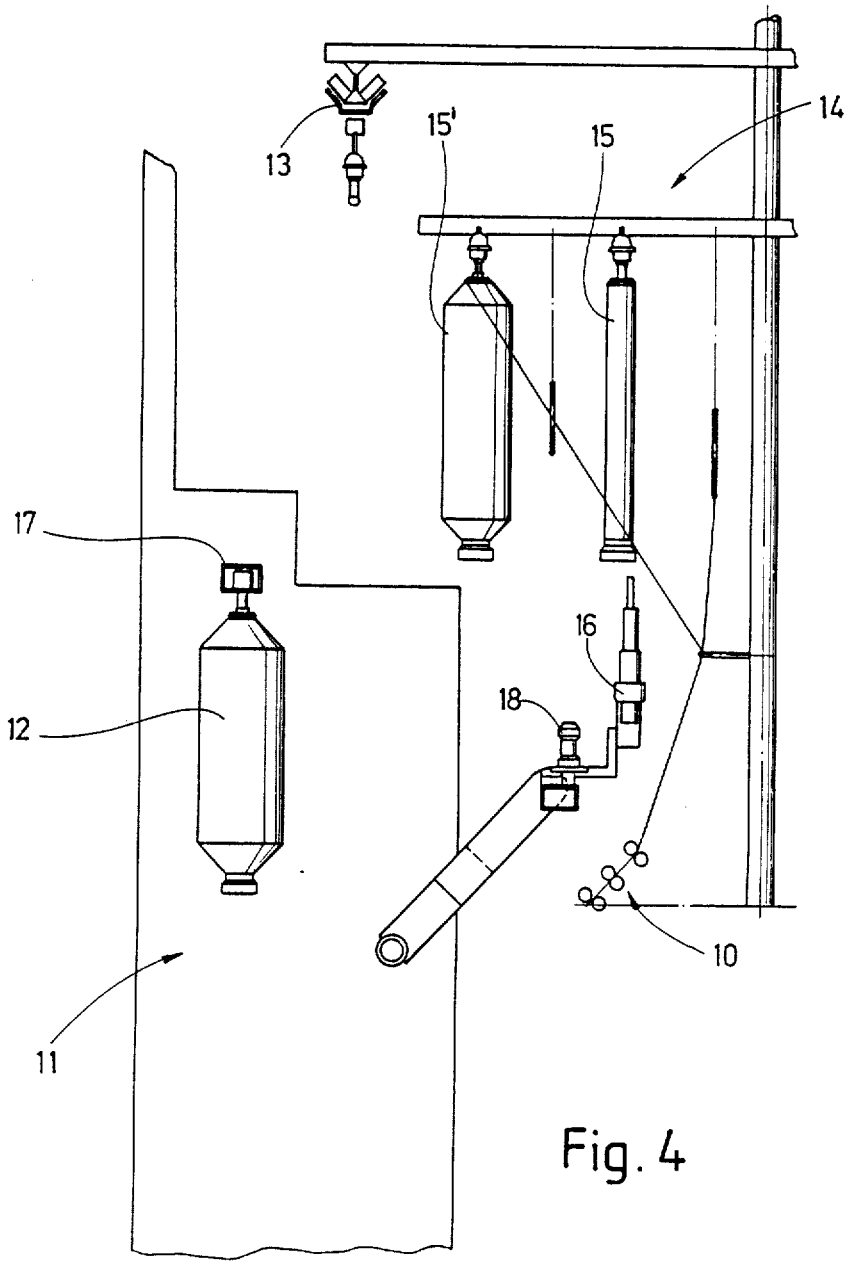
FIG. 4 is a view similar to FIG. 1, showing the full roving bobbin suspended from the temporary storage spindle after the spindle has been returned to its initial position and showing the transfer arm being moved to a position for receiving the empty bobbin thereon.
Figure 5:
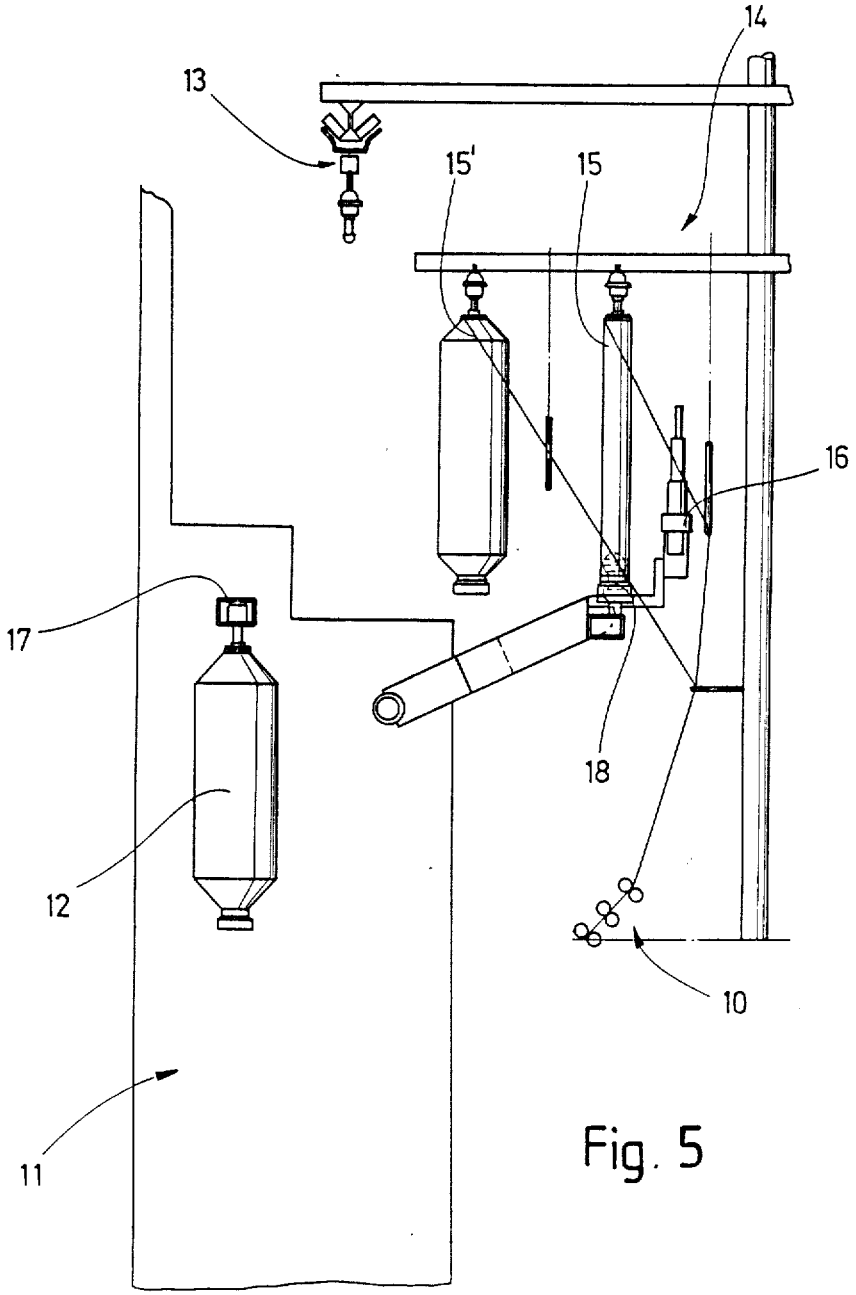
FIG. 5 is a view similar to FIG. 1, showing the empty bobbin received on a spindle of the transfer arm immediately prior to the release of the bobbin from the creel.
Figure 6:
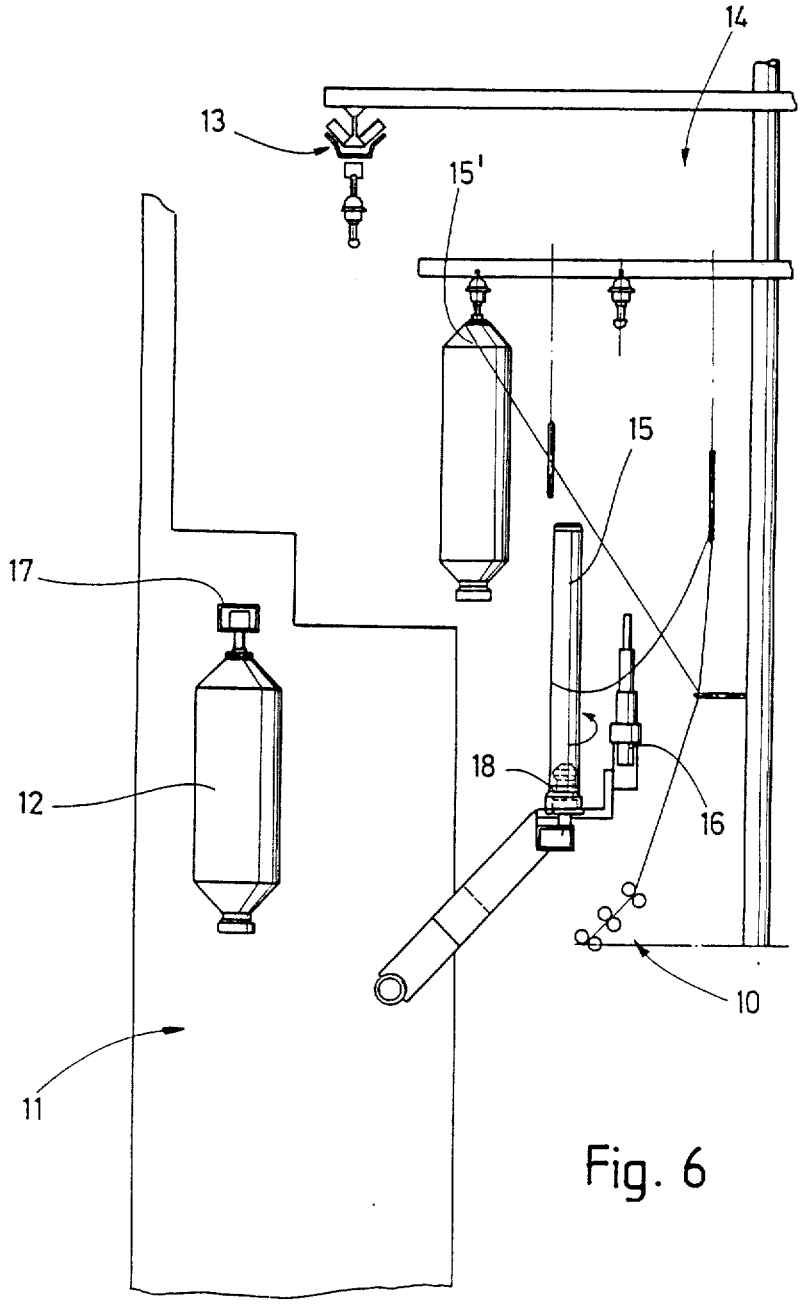
FIG. 6 is a view similar to FIG. 1, showing the empty bobbin immediately after it is released from the creel to be supported by the transfer arm.

As shown in FIG. 4, the temporary storage spindle 17, with the bobbin 12 suspended thereon, is moved horizontally to its initial retracted position while the pivot 33, the transfer arm 32 and the support bracket 19 are moved in coordination to extend the spindle 18 and the cutting and piecing apparatus 16 underneath the empty bobbin 15. As shown in FIG. 5, the pivot 33, the transfer arm 32 and the support bracket 19 are then moved in coordination to insert the spindle 18 into the bottom of the bobbin 15. Thereafter, as shown in FIG. 6, the bobbin 15, entirely supported on the spindle 18, is lowered from its creel 31 through the coordinated movement of the support bracket 19, the transfer arm 32 and the pivot 33. During the lowering step, the spindle 18 is rotated by its drive mechanism so that the unwinding of the roving from the bobbin 15 continues without risk that it will be broken or hang from the bobbin in uncontrollable snarls. The lowering of the spindle 18 continues until the spindle has been moved to its initial position as shown in FIG. 1.

During the movement of the spindle 18 to extend underneath the bobbin 15, engage the bobbin and return with the bobbin thereon to its initial position, the end of the roving on the bobbin 12 is readied for subsequent piecing with the roving of the bobbin 15 by rotating the temporary storage spindle 17 by a conventional rotation mechanism (not shown) to effect unwinding of the roving on the full roving bobbin 12. Also, in coordination with the rotation of the spindle 17, a vacuum device 21 (FIG. 8) mounted on the service unit 11 and positioned adjacent the bobbin 12, is operated to draw the free end of the roving against the vacuum opening to thereby pre-position the roving for its gripping by the cutting and piecing apparatus 16.

Figure 7:
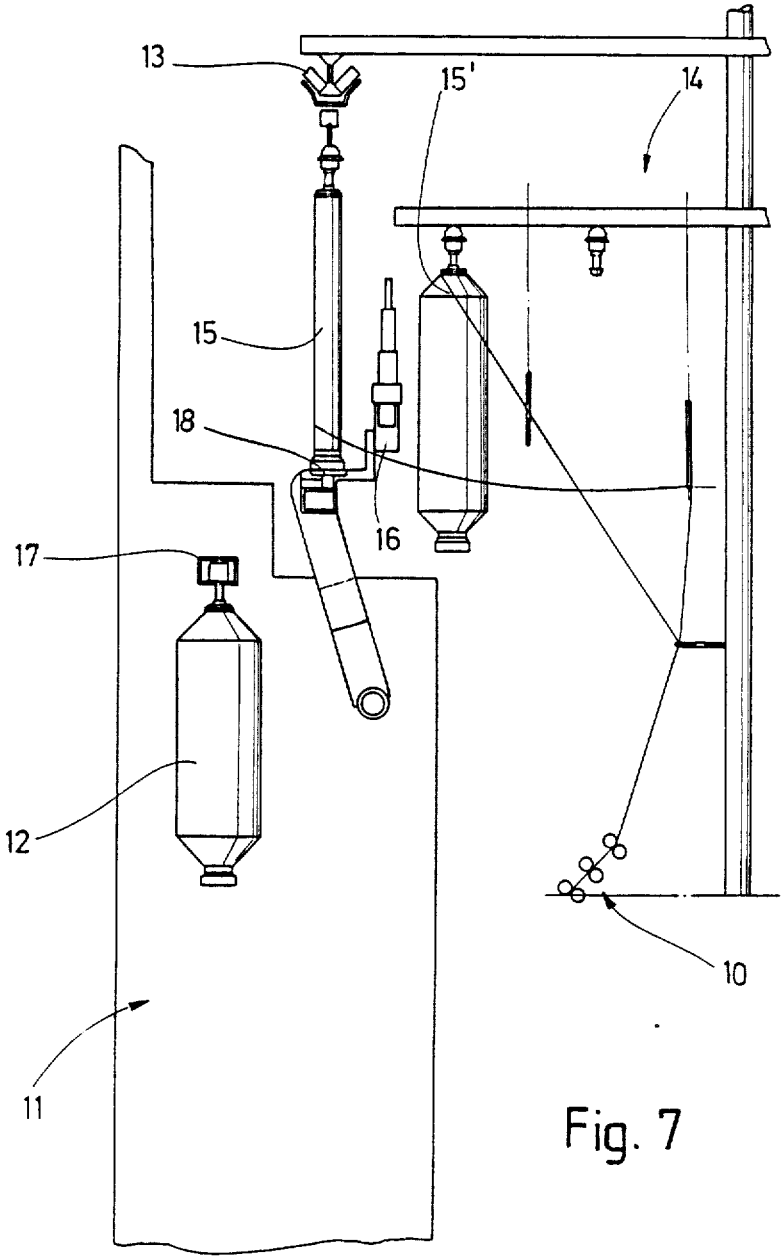
FIG. 7 is a view similar to FIG. 1, showing the empty bobbin being inserted on the creel of the spare bobbin frame by the transfer arm.

As shown in FIG. 7, once the spindle 18 has been retracted to its initial position, the pivot 33 is moved upward so that the empty bobbin 15 is inserted onto the creel 31 on the rail 13. As discussed above, the spindle 18 continues to rotate in coordination with the feed of the roving from the bobbin 15 so that the spinning operation continues uninterrupted.

Figure 8:
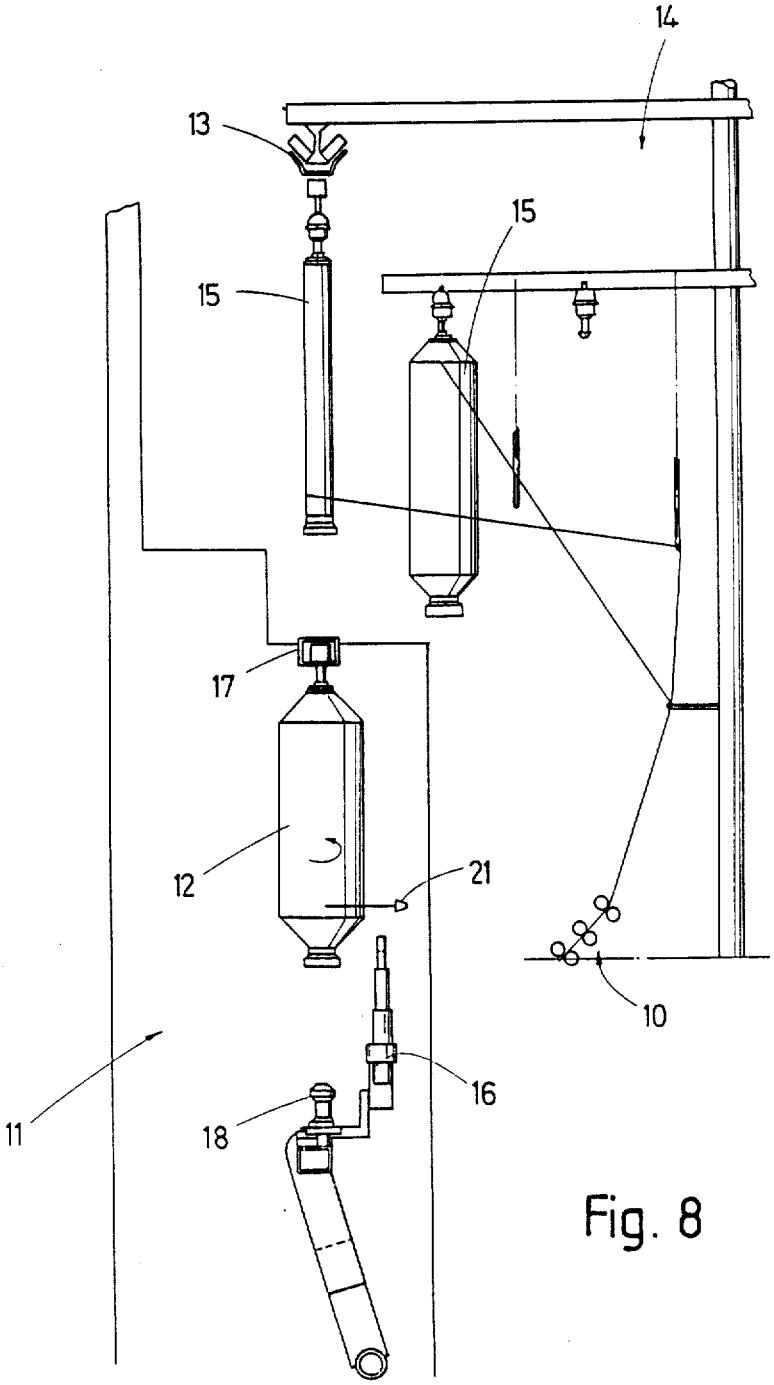
FIG. 8 is a view similar to FIG. 1, showing the empty bobbin suspended from the spare bobbin frame, the transfer arm retracted to its initial position, the full roving bobbin moved by the temporary storage spindle into vertical alignment with the spindle on the transfer arm and the free end of the roving of the full bobbin prior to its engagement by the transfer arm.

Once the empty bobbin 15 has been inserted on the creel 31, the pivot 33 is moved downward to its initial lowermost position and the bobbin is released from the spindle 18 so that it now hangs from the creel 31. As shown in FIG. 8, once the pivot 33 has reached its initial lowermost position, the temporary storage spindle is moved horizontally to bring the full roving bobbin 12 suspended thereon into vertical alignment with the spindle 18. During this horizontal movement, the vacuum device 21 continues to apply a vacuum to the roving of the bobbin 12 so that the roving is held ready to be engaged by the cutting end piecing apparatus 16, as will now be described.

Figure 9:
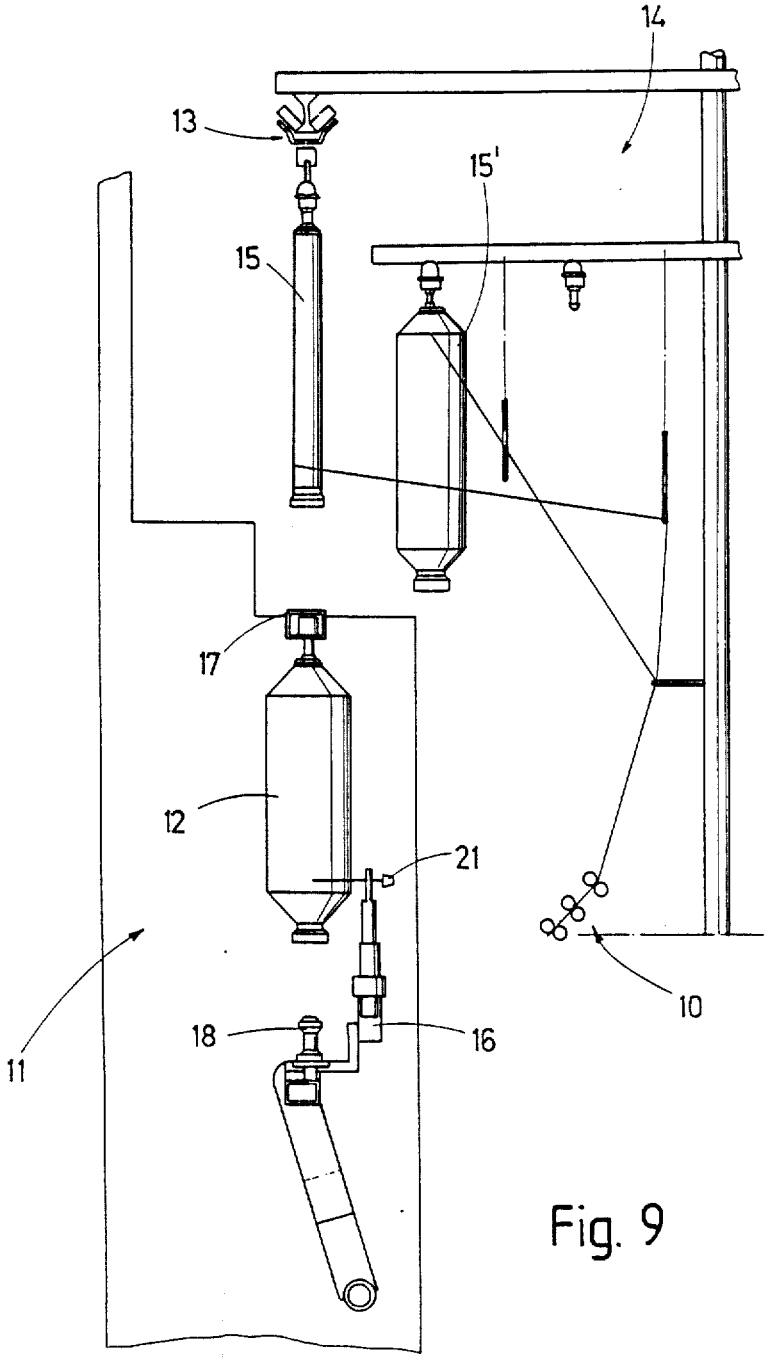
FIG. 9 is a view similar to FIG. 8, showing the free end of the roving of the full bobbin engaged by the transfer arm.
Figure 16:
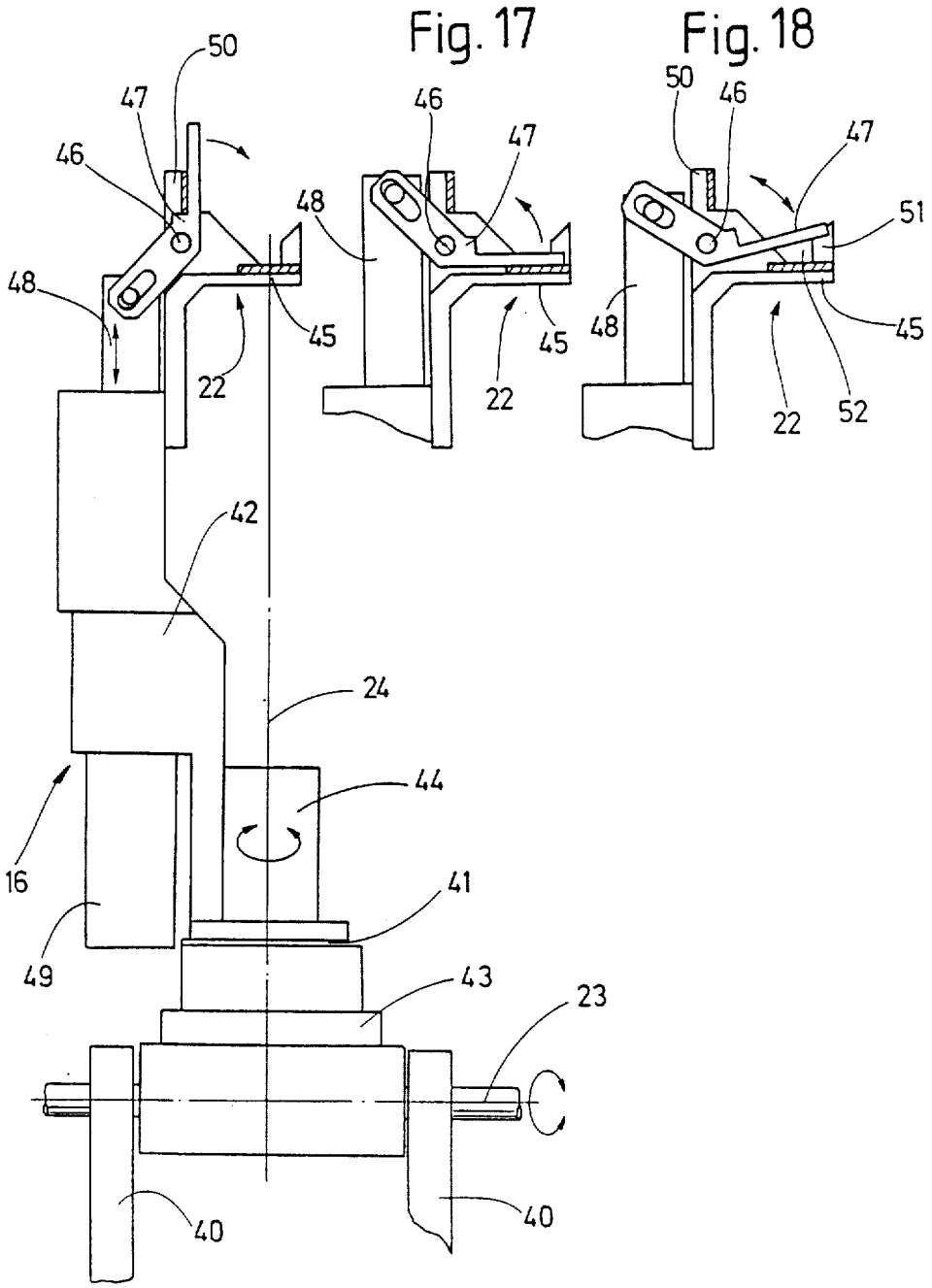
FIG. 16 is an enlargement of the cutting and piecing apparatus of the transfer arm of the automatic roving bobbin exchange apparatus of the present invention, showing the roving gripping jaws in open position.

As shown in FIG. 9, once the full roving bobbin has been positioned in vertical alignment with the spindle 18, the cutting and piecing apparatus 16 is moved to engage the length of roving held ready by the vacuum device 21. With further reference now to the cutting and piecing apparatus 16, the apparatus is illustrated in FIG. 16 in its orientation for receiving and engaging the roving segment from the full bobbin 12 and other operating positions of the cutting and piecing apparatus 16 are illustrated in FIGS. 17 and 18. As shown in FIG. 16, the cutting and piecing apparatus 16 includes a shaft mounted in a yoke 40 of the support bracket 19 for rotation about an axis 23 which is generally transverse to the direction of roving feed. A base 43 mounted to the shaft has a motor 44 which revolves a collar 41 of a member 42 about an axis 24 which is generally parallel to roving feed. The member 42 includes a cylinder 49 for extending and retracting a piston 48 along an axis parallel to and spaced from the axis 24 and also includes a clamping member 22 having a cutting leg 50, a yarn receiving member 45 and a swing arm 47 pivotally coupled to the cutting leg 50 by a pivot 46 and having a longitudinal slot slidably engaging a pin extending from the free end of the piston 48. The yarn receiving member 45 has a resilient pad for laying a yarn thereon and the surface is generally coincident with the axis 24.

As can be understood, the cutting and piecing apparatus 16 has two degrees of movement with respect to the support bracket 19 in that it can be pivoted about the axis 23 and swiveled about the axis 24. During swiveling of the member 42 about the axis 24, the resilient pad of the yarn receiving member 45 remains generally coaxial with the axis 24.

The swing arm 47 is movable between three positions which will now be described. As seen in FIG. 16, when the piston 48 is retracted within the cylinder 49, the swing arm 47, through the above described pin and slot arrangement, pivots in response to the piston movement to bring its free end portion against the cutting leg 50. In this position, the combination cutting and gripper head 22 is ready to receive the unwound roving portion of the full bobbin 12, as shown in FIG. 9. When the roving portion has been placed on the resilient pad of the roving receiving member 45, the piston 48 is then extended out of the cylinder 49 to cause the swing arm 47 to pivot in the direction shown by the arrow in FIG. 16 to the position shown in FIG. 17. As shown in FIG. 17, the free end portion of the swing arm 47 is in pressing contact with the resilient pad of the roving receiving member 45 to thereby non-destructively press the roving segment thereagainst.

The third position to which the swing arm 47 can be moved is shown in FIG. 18 and is achieved by moving the piston 48 such that the free end portion of the swing arm lies slightly above the resilient pad of the roving receiving member 45 and intersects a vertical post 51 on the roving receiving member 45. In this position, the free end portion of the swing arm 47, the post 51 and the receiving member 45 define an eye 52 which functions as a guide, as described in more detail shortly below.

Figure 10:
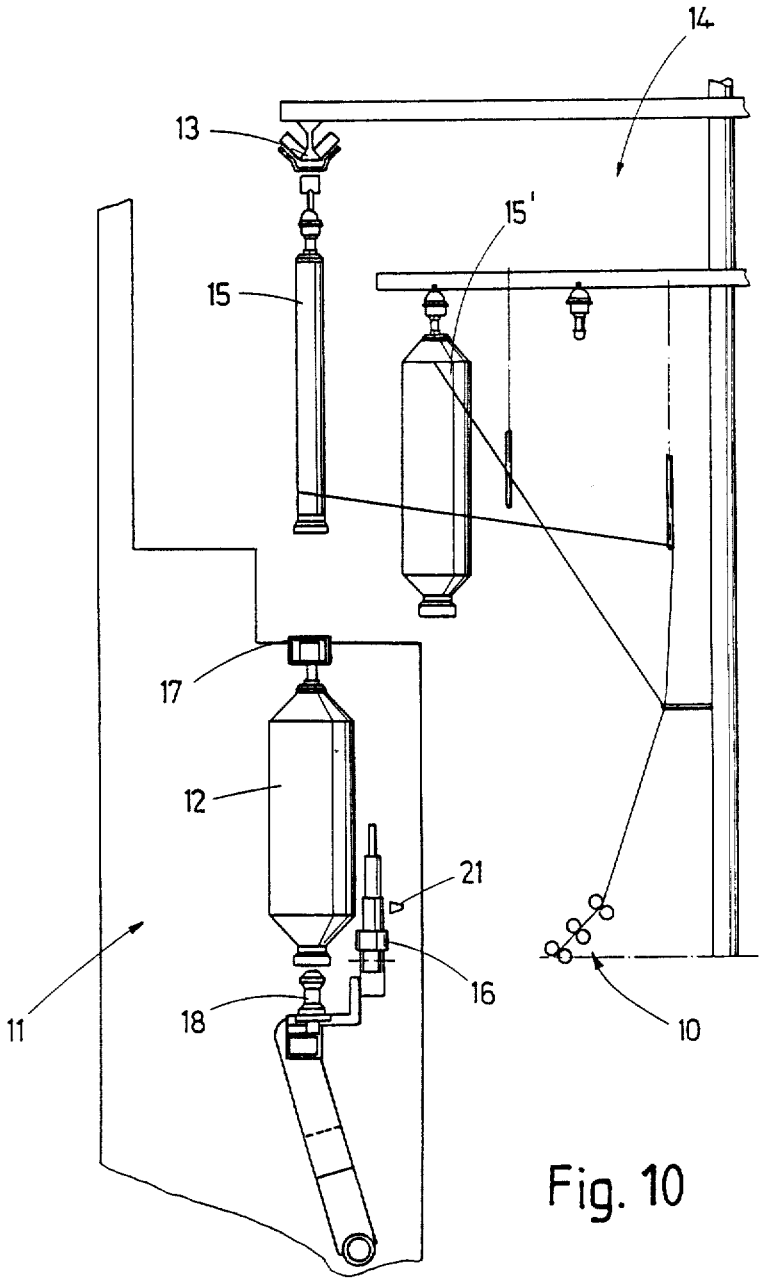
FIG. 10 is a view similar to FIG. 9, showing the transfer arm shortly after it has engaged the free end of the roving of the full bobbin and immediately prior to the insertion of the spindle on the transfer arm into the full roving bobbin.
Figure 11:
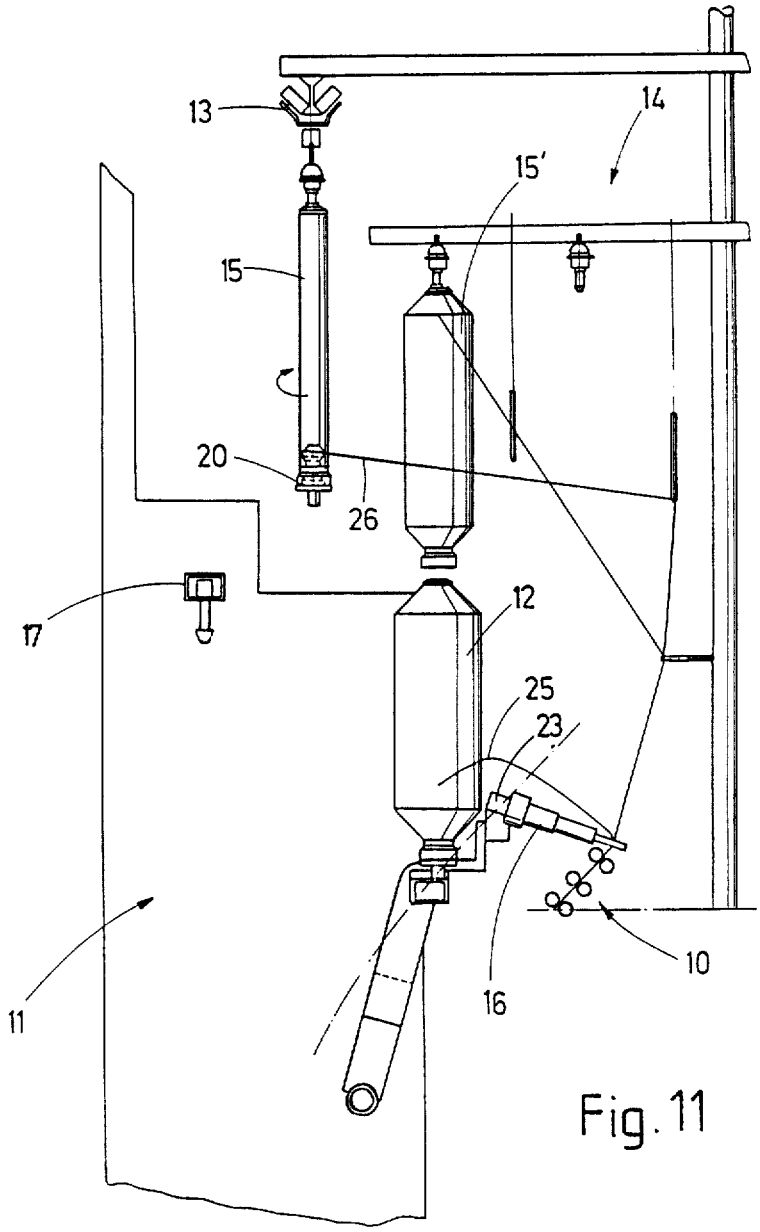
FIG. 11 is a view similar to FIG. 10, showing the full roving bobbin supported on the transfer arm in a position adjacent the drafting apparatus and showing the roving from the full bobbin delivered to the drafting area by the cutting and piecing apparatus immediately before the roving is pieced with the roving being fed from the empty bobbin.
Figure 12:
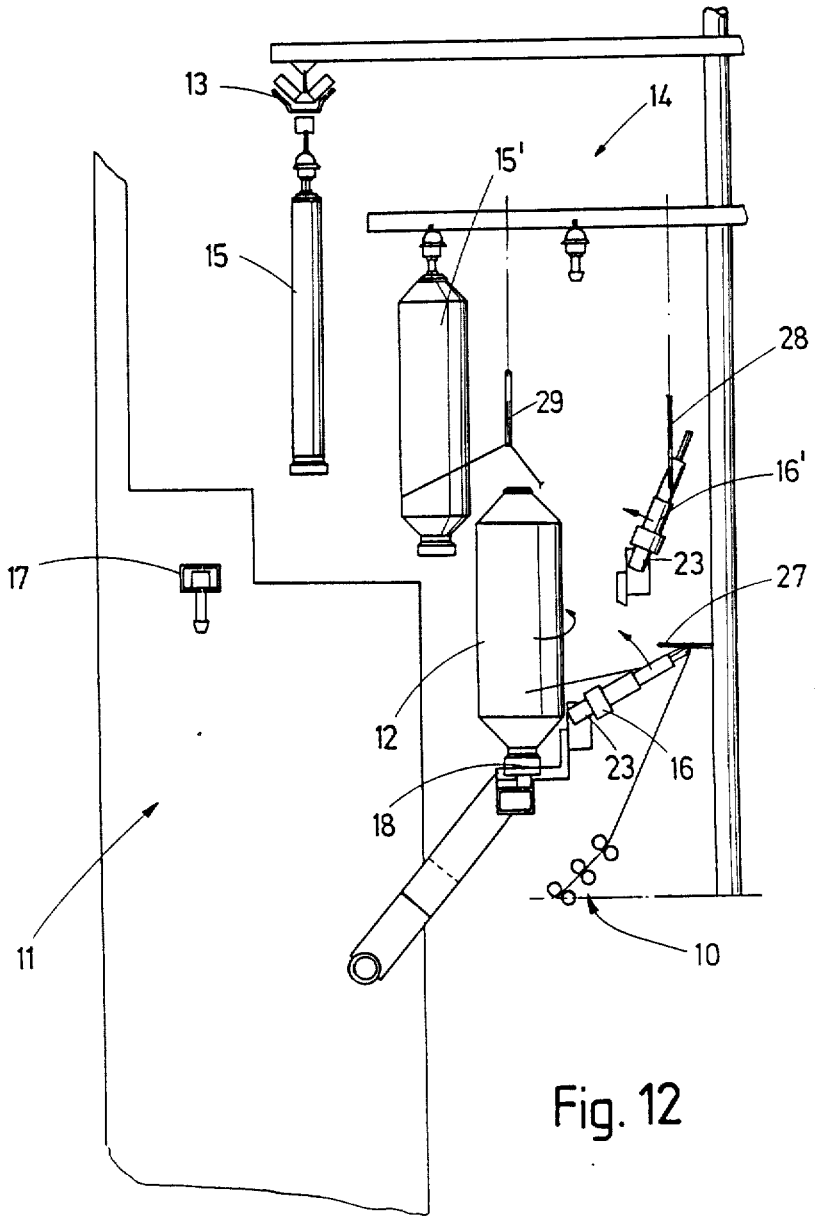
FIG. 12 is a view similar to FIG. 11, showing the cutting and piecing apparatus immediately after it has cut the roving from the empty bobbin and showing the cutting and piecing apparatus in the two positions in which it threads the new roving from the full bobbin onto the guides after the full bobbin has been inserted on the empty creel.

With further reference to FIG. 9, the operation of the automatic roving bobbin exchange apparatus of the present invention will be further described. As noted, the unwound roving segment from the bobbin 12 is firmly yet non-destructively gripped by the cutting and piecing apparatus 16 by manipulation of the swing arm 47 against the receiving member 45 in the grip position is illustrated in FIG. 10. Thereafter, as shown in FIG. 11, the pivot 33, the transfer arm 32 and the support bracket 19 are moved in coordination to bring the cutting and piecing apparatus 16 to a position relative to the drafting apparatus 10 in which the apparatus can be pivoted about the axis 23 to deliver the roving end from the bobbin 12 to the intake of the drafting apparatus 10. To release the roving end so that it can be drawn into the drafting apparatus 10, the piston 48 is retracted into the cylinder 49 causing the swing arm 47 to pivot back to the position shown in FIG. 16. Simultaneously, the cutting and piecing apparatus 16 cuts the roving fed from the empty bobbin 15 to the drafting apparatus 10. This cutting process involves positioning the cutting and piecing apparatus 16 as shown in FIG. 11 such that the cutting leg 50 is brought into contact with the roving from the empty bobbin 15 prior to releasing the yarn end from the bobbin 12. Subsequently, when the swing arm 47 is pivoted back to the position shown in FIG. 16, the free end portion of the swing arm is pivoted against the cutting leg 50 with sufficient force to cut the roving positioned therebetween. Immediately after its roving is cut, the empty bobbin 15 is rotated by a drive mechanism 20 (FIG. 11) to thereby rewind the unwound roving portion 26 onto the bobbin so that the bobbin is ready to be transported away from the ring spinning machine.

After the cutting of the roving from the empty bobbin 15 and the release of the roving from the full bobbin 12, the piston 48 is extended from the cylinder 49 to pivot the swing arm 47 to the yarn guide position shown in FIG. 18 so that the roving unwinding from the bobbin 12 is guided therethrough. Then, the full roving bobbin 12 is moved toward the empty creel which previously supported the empty bobbin 15 in such a manner that the cutting and piecing apparatus 16 passes adjacent a guide 27 mounted on the ring spinning machine. By pivoting about the axis 23, the cutting and piecing apparatus 16 can be pivoted to feed the roving passing through the eye 52 onto the guide 27. Similarly, as the bobbin 12 is inserted onto the empty creel by the automatic roving bobbin exchange apparatus, the cutting and piecing apparatus 16 is pivoted about its axis 23 to thread the roving onto a second guide 28 mounted on the ring spinning machine.

Figure 13:
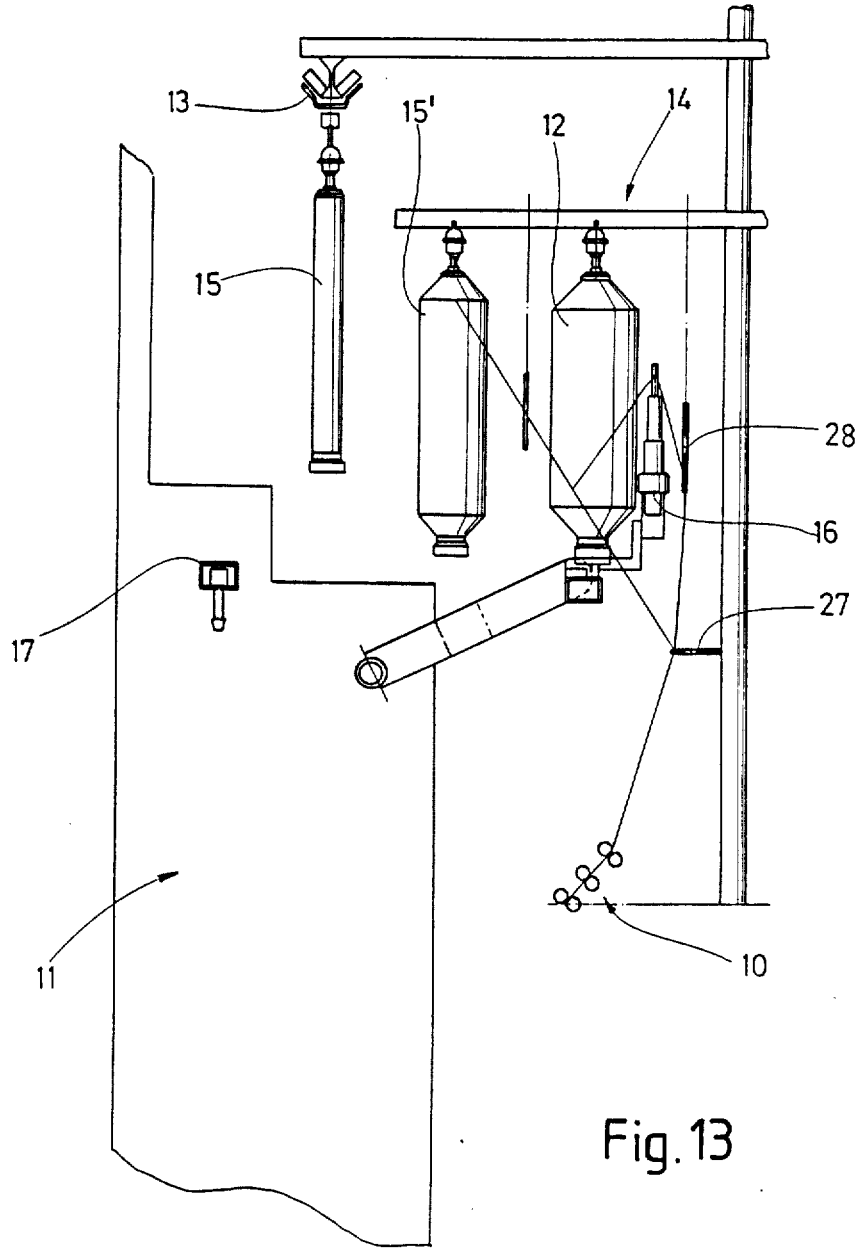
FIG. 13 is a view similar to FIG. 12, showing the full roving bobbin inserted on the empty creel and the cutting and piecing apparatus after it has delivered the roving from the full bobbin to the guide.
Figure 14:
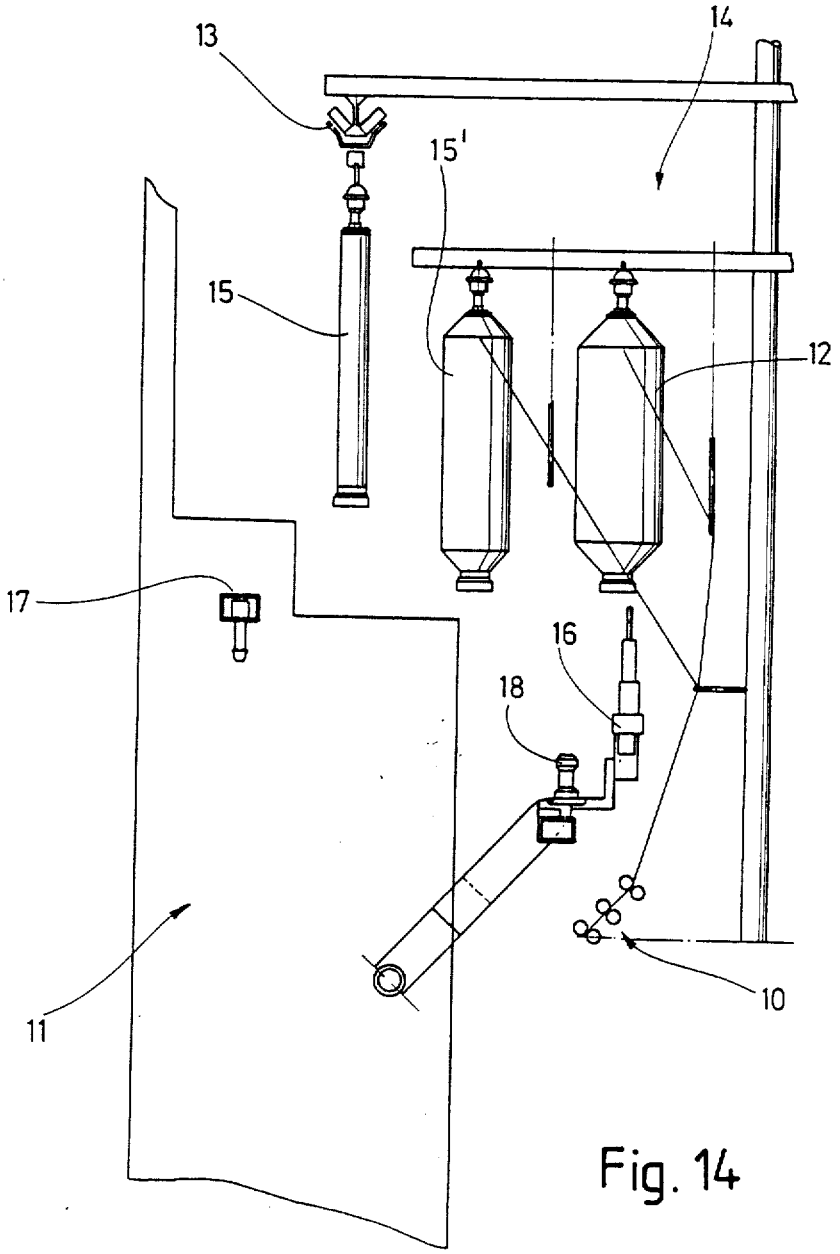
FIG. 14 is a view simialr to FIG. 13, showing the transfer arm retracted downward from the full bobbin and immediately before the transfer arm is pivoted to its initial position on the service unit.
Figure 15:
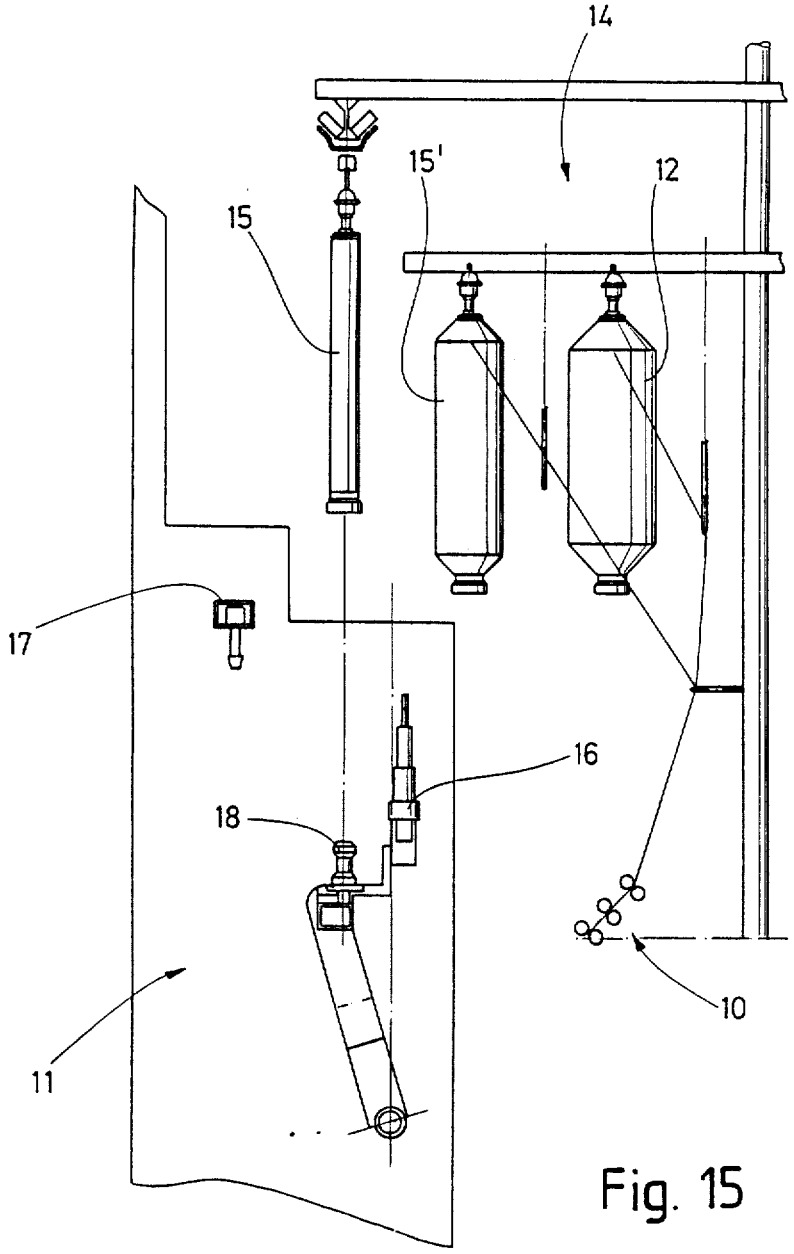
FIG. 15 is a view similar to FIG. 14, showing the transfer arm fully retracted to its initial position on the service unit.

With the roving from bobbin 12 now guided by the guides 27 and 28, the swing arm 47 is pivoted to the open position (shown in FIG. 16) so that the spindle 18 can now be withdrawn from the bobbin 12, as shown in FIG. 13. Subsequently, the spindle 18 is moved towards its initial retracted position on the service unit 11, as shown in FIG. 14, and the spindle is again brought into vertical alignment with the creel 31 on the rail 13, as shown in FIG. 15. Thus, the automatic roving bobbin exchange apparatus is ready to retrieve another full roving bobbin suspended from the rail 13 and exchange it for an empty bobbin 15 or 15'.

Figure 19:
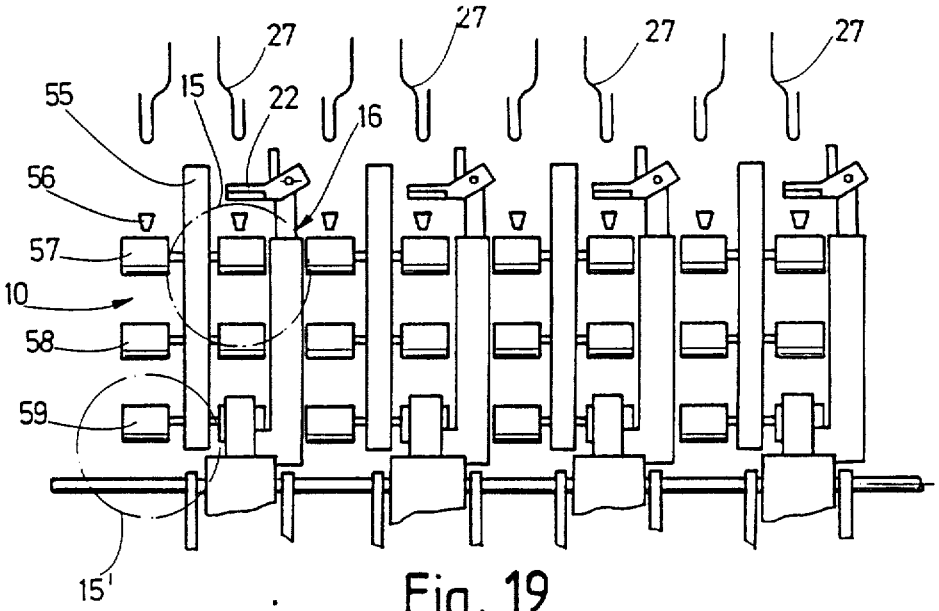
FIG. 19 is a schematic representation of a plurality of drafting areas on a ring spinning frame, showing the cutting and piecing apparatus of the transfer arm of the automatic roving bobbin exchange apparatus of the present invention at each respective drafting area.
Figure 20:
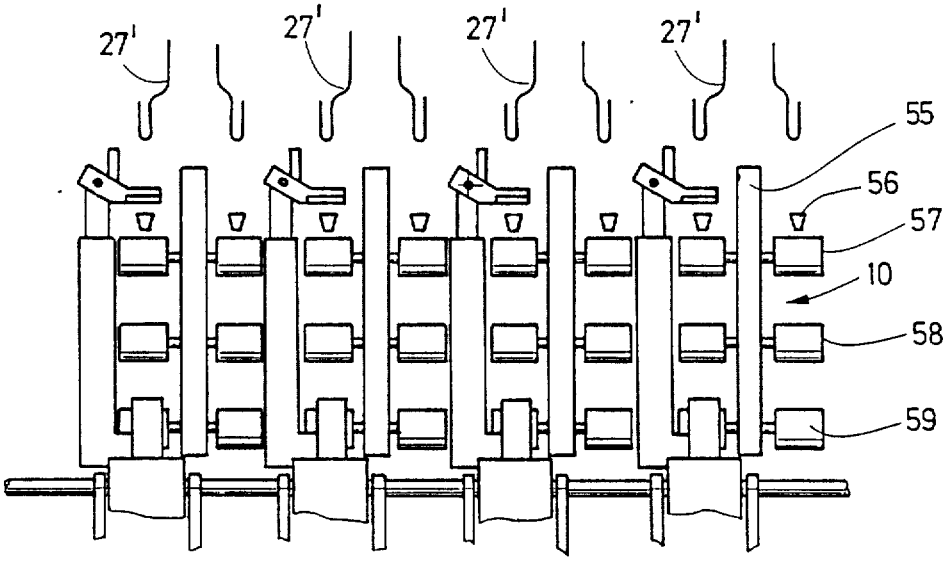
FIG. 20 is a schematic representation of the drafting areas shown in FIG. 19 as seen from the opposite direction, showing the cutting and piecing apparatus of the present invention at each respective drafting area.

With reference now to FIGS. 19 and 20, the cutting and piecing apparatus 16 is advantageously designed to feed roving to two drafting apparatus located on opposite sides of the support bracket 19 without further movement of the bracket. FIG. 19 schematically illustrates a vertical series of drafting rollers 57, 58 and 59 of a drafting apparatus 10 arranged in pairs on a support arm 55. Guide funnels 56 guide roving to the respective rollers from bobbins, such as, for example, the bobbin indicated by the phantom circles 15 and 15'.

There is sufficient space between adjacent drafting roller columns of adjacent support arms 55 such that the cutting and piecing apparatus can be moved inwardly therebetween, as shown in FIG. 19. From this postion, the combination gripping and cutting head 22 can be pivoted to feed roving from a new bobbin into one of the guide funnels 56. As described above with respect to FIGS. 12 and 13, the combination gripping and cutting head 22 can subsequently be raised to pass adjacent the guide 27 (which is preferably hook-shaped to facilitate passage thereby of the head 22) to thread the roving therein. In like manner, the head 22 can be positioned to service the column of drafting rollers on the other side of the automatic roving bobbin exchange apparatus, as shown in FIG. 20. Specifically, as shown in FIG. 16, the yarn receiving member 45 remains coaxial with the axis 24 when the member 42 is swiveled about the axis. Consequently, when the cutting and piecing apparatus 16 is pivoted through 180 degrees to move the head 22 from the position shown in FIG. 19 to the position shown in FIG. 20, the member 42 can be rotated about the axis 24 so that the roving is fed to the feed funnel from the same side as before. Accordingly, the head 22 feeds roving from a full bobbin 12 into a guide funnel 56 before moving upward adjacent the guide 27' to thread the roving therein.

It will therefore be readily understood by those persons skilled in the art that the present invention is susceptible of a broad utility and application. Many embodiments and adaptations of the present invention other than those herein described, as well as many variations, modifications and equivalent arrangements will be apparent from a reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

I claim:

1. Method for exchanging a full roving bobbin stored on an individual bobbin support member of a spare bobbin support means for another roving bobbin on a bobbin holder of a textile machine in which roving is fed from the bobbins for processing in the textile machine, comprising:

transferring the full roving bobbin from the individual bobbin support member of the spare bobbin support means to a service unit adjacent the textile machine;

transferring the another roving bobbin from the bobbin holder to the individual bobbin support member of the spare bobbin support means while substantially continuously maintaining the feed of roving therefrom;

transferring the full roving bobbin from the service unit to the bobbin holder;

piecing the roving from the full bobbin with the roving from the other bobbin; and severing the roving from the other bobbin from the roving from the full bobbin after piecing the roving from the full bobbin therewith.

2. Method for exchanging bobbins according to claim 1 and characterized further by readying the roving end from the full roving bobbin for subsequent piecing of the end with the roving from the roving bobbin before moving the full roving bobbin from the service unit to the bobbin holder.

3. Method for exchanging bobbins according to claims 1 or 2 and characterized further in that said piecing is performed simultaneously with moving the full roving bobbin from the service unit to the bobbin holder.

4. Method for exchanging bobbins according to claim 3 and characterized further in that said piecing includes threading the roving from the full roving bobbin in a guide on the spinning machine.

5. Method for exchanging bobbins according to claim 4 and characterized further in that said piecing includes piecing the rovings in the vicinity of the intake of a drafting apparatus of the ring spinning machine.

6. Method for exchanging bobbins according to claim 3 and characterized further in that said piecing includes piecing the rovings in the vicinity of the intake of a drafting apparatus of the ring spinning machine.

7. Method for exchanging bobbins according to claim 3 and characterized further in that said transferring includes rotating the bobbin in coordination with the feed of the roving therefrom after the roving has been pieced with the roving from the roving bobbin.

8. Method for exchanging bobbins according to claims 1 or 2 and characterized further in that said piecing includes piecing the rovings in the vicinity of the intake of a drafting apparatus of the ring spinning machine.

9. Method for exchanging bobbins according to claims 1 or 2 and characterized further in that said transferring the full roving bobbin from the service unit to the bobbin holder includes rotating the bobbin in coordination with the feed of roving therefrom after the roving has been pieced with the roving from the another roving bobbin.

10. Method for exchanging bobbins according to claims 1 or 2, and characterized further by rotating the roving bobbin on the spare bobbin frame after severing the roving thereof to wind the unwound yarn onto the bobbin.

11. A method according to claim 1 and characterized further in that said spare bobbin support means is a frame mounted to the spinning machine.

12. In a service unit for a textile machine, apparatus for exchanging roving bobbins on a bobbin holder of the textile machine in which roving is fed from the bobbins for processing in the textile machine for full roving bobbins on individual bobbin support members of a spare bobbin support means, comprising:

means for temporarily supporting a bobbin;

means, movable between the bobbin holder, the spare bobbin support means and said temporarily supporting means, for sequentially transferring a full bobbin from an individual bobbin support member of said spare bobbin support means to said temporarily supporting means, transferring another bobbin directly from said bobbin holder to said individual bobbin support member of said spare bobbin support means, and transferring said full bobbin from said temporarily supporting means to said bobbin holder;

means for piecing the roving from the full bobbin with the roving from the said another bobbin; and means for severing the roving from the said another bobbin from the roving from the full bobbin after piecing the roving from the full bobbin therewith.

13. In a service unit for a ring spinning machine, an apparatus according to claim 12 and characterized further in that the means for transferring is movable to additional roving bobbins in lateral disposition to the bobbin on the bobbin holder for transferring the additional bobbins.

14. In a service unit for a ring spinning machine, an apparatus according to claim 13 and characterized further by a gripper for gripping the end of roving of the full roving bobbin.

15. In a service unit for a ring spinning machine, an apparatus according to claim 14 and characterized further in that the means for sequentially transferring includes means for rotating a bobbin supported thereon.

16. In a service unit for a ring spinning machine, an apparatus according to claims 12, 13, 14 or 15 and characterized further by means for pre-positioning the end of the roving from the full bobbin.

17. In a service unit for a ring spinning machine, an apparatus according to claim 16 and characterized further in that the pre-positioning means includes a movable vacuum device.

18. In a service unit for a ring spinning machine, an apparatus according to claim 17 and characterized further in that the gripper includes means for severing the roving from the bobbin.

19. In a service unit for a ring spinning machine, an apparatus according to claim 18 and characterized further in that the gripper includes an outwardly projecting, clamping member for gripping the yarn.

20. In a service unit for a ring spinning machine, an apparatus according to claim 19 and characterized further in that the clamping member is positionable in an open, roving receiving position, a closed, roving gripping position and a partially open, roving guiding position.

21. In a service unit for a ring spinning machine, an apparatus according to claim 20 and characterized further in that the gripper includes means for rotating about an axis generally transverse to the direction of roving feed.

22. In a service unit for a ring spinning machine, an apparatus according to claim 21 and characterized further in that the gripper includes means for rotating about an axis generally parallel to roving feed.

23. In a service unit for a ring spinning machine, an apparatus according to claim 22 and characterized further by means for rotating a bobbin suspended from the temporary support means.

24. In a service unit for a spinning machine, an apparatus according to claim 12 and characterized further in that said spare bobbin support means is a frame mounted to the spinning machine.

25. In a service unit for a textile machine, apparatus for exchanging roving bobbins on a bobbin holder of the textile machine in which roving is fed from the bobbins for processing in the textile machine for full roving bobbins on individual bobbin support members of a spare bobbin support means, comprising:

means for temporarily supporting a bobbin;

means, movable between the bobbin holder, the spare bobbin support means and said temporarily supporting means, for sequentially transferring a bobbin from said bobbin holder to said temporarily supporting means, transferring a full bobbin directly from an individual bobbin support member of said spare bobbin support means to said bobbin holder and transferring the bobbin from said temporarily supporting means to said individual bobbin support member of spare bobbin support means;

means for piecing the roving from the full bobbin with the roving from the bobbin on said spare bobbin support means; and means for severing the roving from the bobbin on said spare bobbin support means from the roving from the full bobbin after piecing the roving from the full bobbin therewith.

26. In a service unit for a spinning machine, an apparatus according to claim 25 and characterized further in that said spare bobbin support means is a frame mounted to the spinning machine.

* * * * *